US005921309A

United States Patent [19]

Nishida et al.

[11] Patent Number: 5,921,309

[45] Date of Patent: Jul. 13, 1999

[54] PRODUCTION PROCESS OF WAX PATTERN

[75] Inventors: Masakatsu Nishida; Koji Sassa, both of Utsunomiya; Tsuyoki Kokubun, Ujiie-machi; Akio Ishida, Utsunomiya; Itaru Tamura, Yokohama, all of Japan

[73] Assignee: Mitsubishi Steel Mfg. Co., Ltd., Tokyo, Japan

[21] Appl. No.: 08/946,103

[22] Filed: Oct. 2, 1997

[30] Foreign Application Priority Data

Apr. 25, 1997 [JP] Japan ..... 9-109259

[51] Int. Cl.[6] ..... B22C 7/02

[52] U.S. Cl. ..... 164/35; 164/45

[58] Field of Search ..... 164/45, 34, 35, 164/516, 235, 246

[56] References Cited

FOREIGN PATENT DOCUMENTS 3-005040 10/1991 Japan .

*Primary Examiner*—Kuang Y. Lin

*Attorney, Agent, or Firm*—Flynn, Thiel, Boutell & Tanis, P.C.

[57] ABSTRACT

A production process of a wax pattern having a core, which is used for casting a product having a complicated hollow portion, comprising the steps of: producing two or more wax shells each having a contour of an external surface of a desired casting; and combining the wax shells with a core to obtain a wax pattern having a hollow portion between the wax shells and the core. Using the method, the occurrence of breakage of the core during dewaxing or production of the pwax pattern is extremely reduced, and a lowering in yield rate due to the breakage of the core is remarkably ameliorated.

1 Claim, 2 Drawing Sheets

PRODUCTION PROCESS OF WAX PATTERN

BACKGROUND OF THE INVENTION

1. Field of the Invention

The present invention relates to the art of preventing a core from being broken during dewaxing or production of a wax pattern to be used in a lost wax casting process for casting a hollow part by using the core.

2. Description of the Prior Art

Castings having hollow portions, such as blades for gas turbines, have cooling holes of complicated shapes in their interiors. A lost wax casting process is widely used for producing such castings, and in that process, it is necessary to produce a wax pattern having a core in advance. The wax pattern is produced by incorporating a ceramic core into wax, and the conventional producing method is normally performed as follows.

FIG. 2 is a plan view of a ceramic core 1, and FIG. 3 is its II—II cross-sectional view. The core 1 has a multiplicity of complicated portions such as through-holes 2, slits 3 and a thin portion 4, and their surrounding portions are very brittle. This core 1 is incorporated into a die 5 as shown in FIG. 5. The die 5 has a cavity 6 having the same shape as the external shape of a casting, and the top side of the die 5 has a nozzle opening 7 through which to inject a wax material. The wax material is normally injected into the cavity 6 through the nozzle opening 7 by an injection machine. The injection pressure is set to approximately ten to several tens of $kgf/cm^2$. The cavity 6 and the through-holes 2 and the slits 3 of the core 1 are charged with the wax material injected into the die 5, and a wax pattern in which the core 1 is coated with wax is formed by cooling and solidifying the wax material.

A plurality of wax patterns each having the above-described form are assembled into a wax cluster. A mold is formed to surround this wax cluster, by investment process or ceramic shell molding process. The wax embedded in the mold (corresponding to the cavity 6) is melted away, excluding the core 1, and the mold is baked at temperatures of 900 to 1,500° C. and molten metal is poured into a cavity formed in the mold after the wax has been melted away. After the solidification of the molten metal, a casting which has the core 1 in its interior is obtained by breaking away the mold and separating the casting cluster. Finally, the casting is dipped into an alkali solution to melt away the remaining ceramic core 1 in the interior of the casting, thereby preparing a casting having a hollow portion corresponding to the shape of the core 1.

In the above-described conventional method, since the surrounding portions of the thin portion 4, the through-holes 2 and the slits 3 in the core 1 are very brittle, they are very frequently broken by high pressure during the injection of the wax material. After the wax material is injected, the core is broken with high frequency by stress due to the solidification of the wax material. Furthermore, a brittler portion of the core 1 is broken earlier with high frequency by the outflow stress of the wax during dewaxing.

SUMMARY OF THE INVENTION

This invention provides a production process of a wax pattern which is capable of preventing a core from being broken during manufacture of a wax pattern owing to stresses such as stress due to injection of a wax material into a die in which the core is incorporated, stress due to solidification of the wax material and outflow stress of wax during dewaxing.

This invention provides a production process of a wax pattern having a core, which is used for casting a product having a complicated hollow portion, comprising the steps of: producing two or more wax shells each having a contour of an external surface of a desired casting; and combining the wax shells with a core to obtain a wax pattern having a hollow portion between the wax shells and the core.

According to the above-described constitution, instead of directly injecting a wax material into a die in which a core is incorporated, two or more wax shells each having a contour of an external surface of a desired casting are produced, and these wax shells are combined with a core to obtain a wax pattern. Accordingly, since the core is not covered with wax, the aforesaid brittle portion of the core is not broken by the wax injection stress. In addition, the core is not broken by stress due to the solidification of the wax. Furthermore, since the amount of wax material flowing during dewaxing is extremely small, the frequency of breakage of the core due to outflow stress is also extremely reduced.

DETAILED DESCRIPTION OF THE PREFERRED EMBODIMENTS

This invention will be specifically described below with reference to an embodiment.

Figure 1:
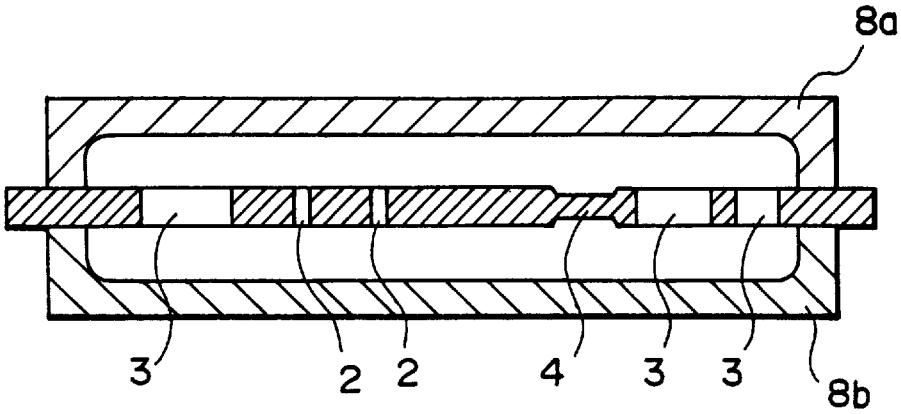
FIG. 1 is an explanatory view of an embodiment of this invention.
Figure 2:
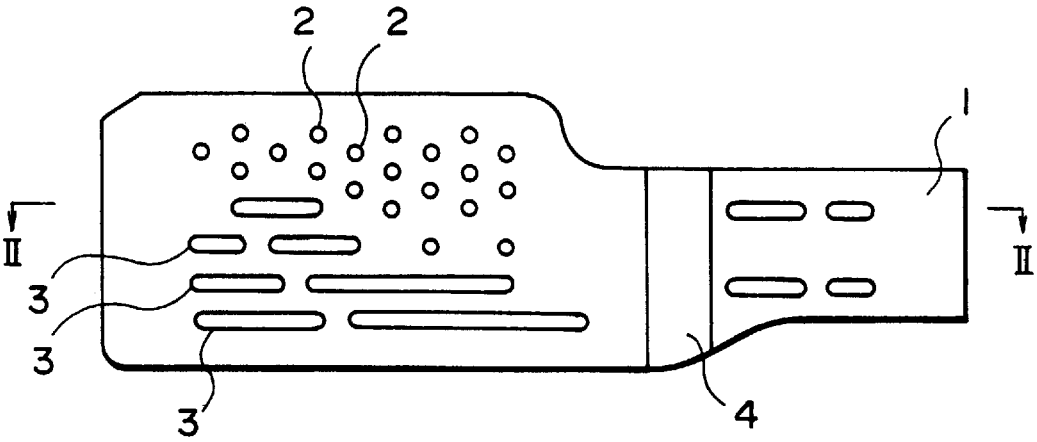
FIG. 2 is a plan view of one example of a core used in this invention.
Figure 3:
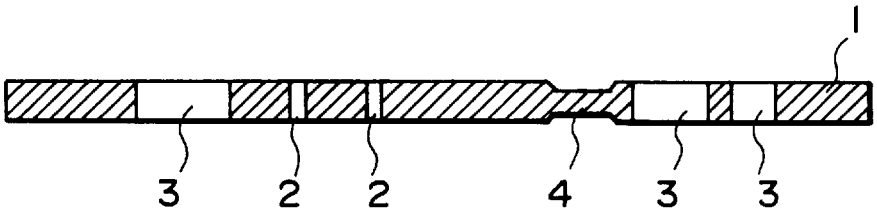
FIG. 3 is a II—II cross-sectional view of FIG. 2.
Figure 4:
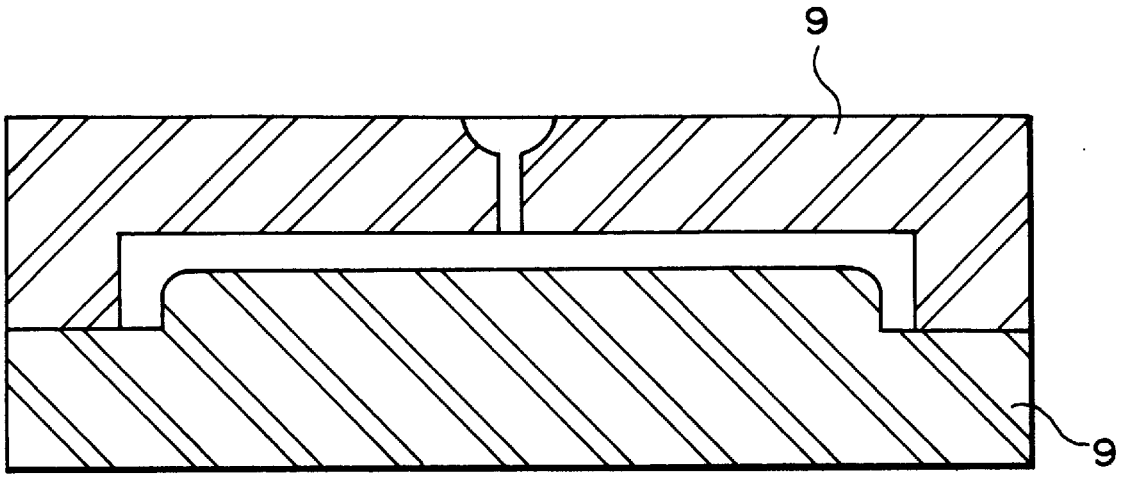
FIG. 4 is an explanatory view of the manufacture of a wax shell in the present invention.
Figure 5:
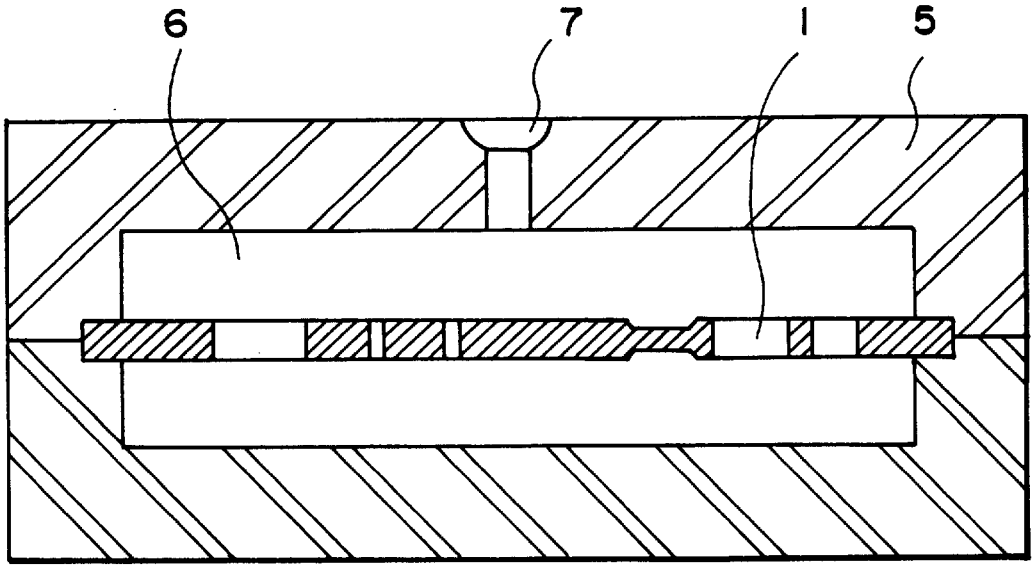
FIG. 5 PRIOR ART
FIG. 5 is an explanatory view of a conventional process.

In FIG. 1, reference numerals 8*a* and 8*b* denote wax shells. These wax shells 8*a* and 8*b* are obtained, for example, using a die 9 which is shown in FIG. 4, by injecting wax into the die 9 by a normal injection process, and forming part of a portion corresponding to the contour of the external surface of a product into a shell-like shape. The wax shells 8*a* and 8*b* and a core 1 are combined to prepare the wax pattern shown in FIG. 1. In the subsequent process, a predetermined thin hollow cast part is manufactured in a way similar to the above-described prior art.

Thus, the occurrence of breakage of the core is extremely reduced, and a lowering in yield rate due to the breakage of the core is remarkably ameliorated.

In accordance with this invention, since neither wax injection stress nor wax solidification stress at all works on the brittle portion of a core during production of a wax pattern, the core is not broken by such stresses. In addition, since the amount of wax to be melted during dewaxing is extremely small compared to the conventional process, the frequency of breakage of the core due to outflow stress is also extremely reduced. In other words, this invention remarkably ameliorates a lowering in yield rate due to the breakage of the core.

What is claimed is:

1. A production process of a wax pattern having a core, which is used for casting a product having a complicated hollow portion, comprising the steps of: producing two or more wax-shells each having a contour of an external surface of a desired casting; and combining the wax shells with a core to obtain a wax pattern having a hollow portion between the wax shells and the core.

* * * * *